US008945463B2

(12) United States Patent
Goedert et al.

(10) Patent No.: US 8,945,463 B2
(45) **Date of Patent: *Feb. 3, 2015**

(54) TUYERE STOCK ARRANGEMENT FOR A BLAST FURNACE AND METHOD FOR FEEDING HOT BLAST INTO A BLAST FURNACE

(75) Inventors: Paul Goedert, Mondorf-les-Bains (LU); Lionel Hausemer, Steinsel (LU); Jean-Paul Simoes, Walferdange (LU)

(73) Assignee: Paul Wurth S.A., Luxembourg (LU)

( * ) Notice: Subject to any disclaimer, the term of this patent is extended or adjusted under 35 U.S.C. 154(b) by 241 days.

This patent is subject to a terminal disclaimer.

(21) Appl. No.: 13/257,157

(22) PCT Filed: Mar. 22, 2010

(86) PCT No.: PCT/EP2010/053671

§ 371 (c)(1),
(2), (4) Date: Sep. 16, 2011

(87) PCT Pub. No.: WO2010/108880

PCT Pub. Date: Sep. 30, 2010

(65) Prior Publication Data

US 2012/0007291 A1 Jan. 12, 2012

(30) Foreign Application Priority Data

Mar. 24, 2009 (LU) ..... 91543

(51) Int. Cl.
*F27B 1/00* (2006.01)
*C21B 7/16* (2006.01)
*F27B 1/16* (2006.01)

(52) U.S. Cl.
CPC .. *C21B 7/163* (2013.01); *F27B 1/16* (2013.01)
USPC ..... 266/47; 266/268

(58) Field of Classification Search
CPC ..... C21B 7/163
USPC ..... 266/44, 47, 265, 268
See application file for complete search history.

(56) References Cited

U.S. PATENT DOCUMENTS

| | | | | |
|---|---|---|---|---|
| 4,138,098 | A | 2/1979 | Leroy | |
| 5,451,034 | A * | 9/1995 | Ulveling et al. | 266/182 |
| 2013/0061786 | A1 * | 3/2013 | Simoes et al. | 110/182.5 |

FOREIGN PATENT DOCUMENTS

| | | |
|---|---|---|
| CN | 1916187 A | 2/2007 |
| EP | 0447908 A1 | 9/1991 |

(Continued)

OTHER PUBLICATIONS

Japenese Office Action for corresponding application P2012-510268; Mailing Date May 15, 2013.

(Continued)

*Primary Examiner* — Scott Kastler
(74) *Attorney, Agent, or Firm* — Cantor Colburn LLP

(57) ABSTRACT

Tuyere stock arrangement (10) of a blast furnace comprising a tuyere (14) having a tuyere body (20) configured for installation in a blast furnace wall (12); the tuyere body (20) having an outer wall (22), a front face (24) and a rear face (26), the tuyere body (20) further having a tuyere channel (28) extending from the rear face (26) to the front face (24), the tuyere channel (28) forming an inner wall (30) in the tuyere body (20). The tuyere stock arrangement (10) further comprises a blowpipe (34) connected between the rear face (26) of the tuyere body (20) and a gas feeding device (38), the blowpipe (34) being configured and arranged so as to feed hot gas, generally hot blast air, from the gas feeding device (38) to the tuyere channel (28) for injection into the blast furnace. The tuyere stock arrangement (10) also comprises an injection lance (40) for feeding a combustible, generally pulverized or granular coal, into the blast furnace at the tuyere level, the injection lance (40) being an coaxial lance comprising an outer pipe and an inner pipe, coaxially arranged within the outer pipe, the outer and inner pipes being arranged for separately conveying oxidizing gas and said combustible, the inner pipe forming a separation wall for separating said combustible from the oxidizing gas. According to an important aspect of the invention, the injection lance (40) is removably arranged in a lance passage (42) formed in the tuyere body (20), the lance passage (42) being arranged between the inner wall (30) and the outer wall (22) of the tuyere body (20) and extending from the rear face (26) to the front face (24), the lance passage (42) opening into a front lace (24) of the tuyere body (20).

14 Claims, 2 Drawing Sheets

(56) References Cited

FOREIGN PATENT DOCUMENTS

| | | | |
|---|---|---|---|
| FR | 2328773 | A | 5/1977 |
| GB | 400793 | A | 11/1933 |
| JP | 60161156 | U | 10/1985 |
| JP | 6178849 | | 5/1986 |
| JP | 05125411 | | 5/1993 |
| KR | 20020032674 | A | 5/2002 |
| LU | 66460 | A1 | 2/1973 |
| LU | 88437 | a1 | 10/1994 |
| WO | 2007133050 | A1 | 11/2007 |

OTHER PUBLICATIONS

International Search Report PCT/EP2010/053671; Oct. 27, 2010.
Chinese Office Action for corresponding application No. 201080011345.7 filed Mar. 22, 2010; Mail date Jan. 31, 2013.

* cited by examiner

TUYERE STOCK ARRANGEMENT FOR A BLAST FURNACE AND METHOD FOR FEEDING HOT BLAST INTO A BLAST FURNACE

TECHNICAL FIELD

The present invention generally relates to a novel tuyere stock arrangement for a blast furnace and a method for feeding hot blast into a blast furnace while injecting a combustible into the blast furnace.

BACKGROUND

It is well known that the injection of pulverized or granular coal into the hot-air blast, which is blown through a plurality of tuyeres into a lower portion of the blast furnace, has many advantages. In particular, it increases the production capacity of the blast furnace and allows significant quantities of coke to be replaced by coal, which is far less expensive.

The injection of pulverized or granular coal is performed conventionally by means of an injection lance into the hot-air blast at a certain distance upstream from the tuyere end opening into the furnace. In other words, the coal is injected into the blowpipe or into the hot-air passage in the tuyere. The coal fed through the lance is in suspension in an inert gas and the oxidizing gas is either constituted by the hot-air blast or by pure oxygen, brought in via a separate pipe close to the nozzle end of the lance.

The combined injection of coal and oxidizing gas has been suggested e.g. in EP 0 447 908, wherein the injection is performed through a coaxial lance, wherein an outer tube is arranged surrounding an inner tube. The inner tube forms a separation wall between the oxidizing gas and the coal until both reach an outlet nozzle of the lance. Such coaxial injection lances are often referred to as oxycoal lances. In EP 0 447 908, oxidizing gas is conveyed in the outer tube and coal is conveyed in the inner tube.

Generally, the injection lance is fed through a wall portion of the blowpipe into the latter and has its outlet nozzle located preferably centrally within the flow of hot-air blast, thereby causing the hot-air blast to surround the injected coal.

In such a lance arrangement, the injection lance is subject to being damaged due to the exposure to the hot-air blast. Due to the high temperatures in the blowpipe, the lance may be deformed, which in turn may be detrimental to the correct injection of oxidizing gas and coal. Furthermore, at the tip of the lance, the conveyed coal comes into contact with the conveyed oxidizing gas, thereby creating a flame at the tip of the lance. This flame further puts at risk the tip of the lance, as well as the inner walls of the blowpipe or tuyere.

The injection of coal, in particular in combination with an oxidizing gas, becomes problematic if the gas fed through the blowpipe and tuyere is not hot-air, as is the case in conventional blast furnaces, but a reduction gas, such as is the case with blast furnaces with top gas recycling, wherein the top gas may, after treatment, be injected back into the blast furnace through the tuyere stock arrangement. It should also be noted that in the known tuyere stock arrangements, wherein the injection lance is arranged in the flow of gas through the blowpipe, the inner wall of the tuyere is at risk of being damaged by the injected coal, in particular if the tuyere nose has a reduced outlet diameter or if the coal is injected at high velocity. In case the tuyere nose has a reduced outlet diameter, the injection lance also causes a visual obstruction, at least partially preventing the blast furnace conditions to be visually monitored through the tuyere via a peep sight arranged in a bend of the blowpipe, in linear alignment with the tuyere.

BRIEF SUMMARY

The invention provides an improved tuyere stock arrangement of a blast furnace. The invention further provides an improved method for operating a blast furnace.

The present invention proposes a tuyere stock arrangement of a blast furnace comprising a tuyere having a tuyere body configured for installation in a blast furnace wall; the tuyere body having an outer wall, a front face and a rear face, the tuyere body further having a tuyere channel extending from the rear face to the front face, the tuyere channel forming an inner wall in the tuyere body. The tuyere stock arrangement further comprises a blowpipe connected between the rear face of the tuyere body and a gas feeding device, the blowpipe being configured and arranged so as to feed hot gas, generally hot blast air, from the gas feeding device to the tuyere channel for injection into the blast furnace. The tuyere stock arrangement also comprises an injection lance for feeding a combustible into the blast furnace at the tuyere level, the injection lance being a coaxial lance comprising an outer pipe and an inner pipe, coaxially arranged within the outer pipe, the outer and inner pipes being arranged for separately conveying oxidizing gas and a combustible, the inner pipe forming a separation wall for separating the combustible from the oxidizing gas. According to an important aspect of the invention, the coaxial injection lance is removably arranged in a lance passage formed in the tuyere body, the lance passage being arranged between the inner wall and the outer wall of the tuyere body and extending from the rear face to the front face, the lance passage opening into a front face of the tuyere body.

By providing a lance passage through the tuyere body, the coaxial injection lance is not exposed to the heat from the hot gas blown through the blowpipe and the tuyere. Consequently, the injection lance is not at risk of being attacked by the hot gas. Indeed, a lance arranged in the path of the hot gas is, due to the high temperature of the hot gas, at risk of being deformed or destructed. By removing the injection lance out of the path of the hot gas, this risk can be reduced. Also, the injection lance does not penetrate into the path of the hot gas fed through the blowpipe or the tuyere channel. Thus, the lifetime of the injection lance can be improved. Furthermore, the injection lance does not cause a visual obstruction between a peep sight and the tuyere nose.

It should also be noted that, in case of a stoppage, it has in the past been necessary, in order to prevent damage to the lance, to move the injection lance into a park position or even to remove it from the tuyere stock arrangement. According to the present invention, although it may still be desired to remove the lance in some cases, it is however generally no longer necessary as the lance is well protected by the tuyere body surrounding the lance. By removably arranging the injection lance in the lance passage, it should also be noted that the injection lance can easily be removed is such is necessary or desired. When installed, the coaxial injection lance is capable of simultaneous feeding oxidizing gas and a combustible to the front face of the tuyere.

Removing the injection lance out of the path of the hot gas furthermore also allows warranting a generally good hot gas distribution. Indeed, The burning of the flame at the tip of the injection lance is not always the same for all tuyeres. This may lead to a more important pressure drop across a particular tuyere, which may lead to a non-ideal distribution of hot gas. By placing the injection lance outside the path of the hot gas, this effect can be avoided.

Advantageously, the oxidizing gas is heated oxidizing gas and/or the combustible is heated combustible. The oxidizing gas and/or the combustible can be heated to a temperature of at least 150° C., preferably about 200° C., before feeding it through the injection lance. The feeding of heated oxidizing gas and/or combustible improves the combustion conditions of the combustible at the tip of the lance. The time necessary to bring the combustible to its combustion temperature, once it has exited the lance, is reduced. Consequently, combustion of the combustible may occur earlier and closer to the tip of the lance.

It should be noted that in the context of the present application the combustible injected through the injection lance is preferably pulverized or granular coal. Other combustibles, such as granulated plastics, animal grease or flour, liquid fuel, natural gas or shredded tires may however also be used.

The tuyere body preferably comprises cooling channels therein. Such cooling channels are generally arranged between the inner wall and the outer wall of the tuyere body and are configured to carry a cooling medium therethrough. The cooling channels, through which a cooling medium, generally water, is directed, allow to cool down the tuyere body, and thereby protect the latter from excessive temperatures which could otherwise melt the tuyere material. As the injection lance is arranged through the tuyere body, the injection lance is also cooled.

The injection lance is thereby protected and consumption of the lance is stopped, thus prolonging the lifetime of the lance. It should be noted that the cooling channels are preferably adapted so as to allow the lance passage to extend through the tuyere body and to optimize the cooling of the lance without however impairing the cooling of the tuyere body. The cooling channels arranged in the tuyere body thus increase the lifetime of the tuyere as well as that of the injection lance.

Preferably, the lance passage and the injection lance are dimensioned such that an annular gap is arranged between the injection lance and the tuyere body. Such an annular gap forms an insulation layer between the injection lance and the tuyere body. Furthermore, the annular gap facilitates installation of the injection lance into the lance passage and its removal therefrom. Indeed, it may be necessary to remove the injection lance from the lance passage. In order to avoid damage to the lance passage, a gas may be blown through the lance passage for cooling and/or purging thereof. Furthermore, a plug-in rod may be inserted into the lance passage to avoid that any materials enters the lance passage from the furnace side.

Advantageously, a front end of the injection lance has a conical shape narrowing in direction of the lance tip, the lance passage having a corresponding narrowing at the front end of the lance passage, such that, when the injection lance is installed in the lance passage, the outer pipe is, in a front end of the lance passage, in contact with the tuyere body. This ensures that the injection lance cannot be installed too far into the lance passage, thereby avoiding that the lance tip protrudes from the lance passage into the furnace itself. Thus this ensures that the injection lance remains within the protective shell formed by the tuyere body. Unnecessary consumption of the lance can thereby be avoided. Furthermore, the conical shape and corresponding narrowing of the lance passage allows for the outer pipe of the lance to come into contact with the tuyere body. The conical shape preferably snuggly fits into the narrowed front portion of the lance passage. This contact allows for a cooling of the lance tip via the cooled tuyere body, thereby further ensuring that the lance tip is protected from consumption.

In a front end of the injection lance, the injection lance may be provided with an annular protrusion on an inner wall of the outer pipe and/or an outer wall of the inner pipe. The annular protrusion reduces the flow cross-section of the annular channel carrying the oxidizing gas. Such a reduction of the flow cross-section increases the velocity of the oxidizing gas passing therethrough and therefore improves penetration of the oxidizing gas into the furnace.

The tuyere stock arrangement preferably further comprises a lance holder with a hollow pipe having a central passage dimensioned so as to receive the injection lance therethrough, the lance holder having a first end connected to the rear face of the tuyere body and an opposite second end protruding out of the blast furnace wall. Such a lance holder facilitates the access of the injection lance to the lance passage arranged through the tuyere body. Indeed, the rear face of the tuyere body is generally arranged deep inside the furnace wall and is therefore only accessible with great difficulty. The lance holder is connected to the rear face of the tuyere body and has its central passage in alignment with the lance passage in such a way that the central passage of the lance holder becomes an extension to the lance passage. The lance holder extends to a region outside the blast furnace wall, thereby making the entrance to the lance passage more accessible, e.g. for removal or insertion of an injection lance.

Advantageously, a removable tuyere insert is arranged in the tuyere channel of the tuyere body, the tuyere insert being configured so as to modify an outlet cross-section of the tuyere. Such a tuyere insert allows modifying the flow conditions through the tuyere. The tuyere insert can be removed and, if desired, replaced with a different tuyere insert. This allows altering the raceway shape and gas distribution into the blast furnace without having to dismantle the tuyere body itself. Different flow conditions may be desired depending on the operating conditions of the blast furnace.

According to an aspect of the invention, the hot gas carried by the gas feeding device may comprise recycled treated top gas, which acts as reduction gas in the blast furnace. If such reduction gas is fed through the blowpipe and tuyere channel, the arrangement of the injection lance through a lance passage as described above is of particular importance. Indeed, the present arrangement allows avoiding contact, within the tuyere stock arrangement, between the reducing gas carried by the blowpipe and tuyere and the oxidizing gas and the combustible carried by the injection lance.

It should further be noted that the invention is not limited to the provision of a single lance passage and a single injection lance. Indeed, two or more lance passages may be provided in the tuyere body.

The present invention further proposes a method for feeding hot blast through a tuyere stock arrangement of a blast furnace, the method comprising the following steps:

providing a tuyere stock arrangement comprising a tuyere having a tuyere body installed in a blast furnace wall; the tuyere body having an outer wall, a front face and a rear face, the tuyere body further having a tuyere channel extending from the rear face to the front face, the tuyere channel forming an inner wall in the tuyere body, the tuyere stock arrangement further comprising a blowpipe connected between the rear face of the tuyere body and a gas feeding device, the blowpipe being configured and arranged so as to feed hot gas from the gas feeding device to the tuyere channel for injection into the blast furnace;

providing the tuyere body with a lance passage extending from the rear face to the front face of the tuyere body, the lance passage being arranged between the inner wall and the outer wall of the tuyere body, the lance passage opening into the front face of the tuyere body;

providing an injection lance for feeding a combustible into the blast furnace and removably arranging the injection lance in the lance passage;

feeding a hot gas from the gas feeding device through the blowpipe and the tuyere channel into the blast furnace; and separately feeding a combustible and oxidizing gas into the blast furnace through the injection lance.

This method allows feeding oxidizing gas and a combustible into the blast furnace, without subjecting the injection lance to the extreme conditions reigning in the blowpipe and/or in the tuyere. By arranging the injection lance in the lance passage of the tuyere body, the lance is protected and is therefore not deformed or destructed through exposure to the high temperatures of the hot gas blown through the blowpipe and the tuyere. Exposure to harsh conditions is limited to the tip of the injection lance. The coaxial injection lance can easily be removed if this is necessary or desired. The injection lance is easily replaceable because it is removably arranged in the lance passage. When installed, the coaxial injection lance allows the simultaneous feeding of feeding oxidizing gas and a combustible to the front face of the tuyere.

Preferably, method comprises the further step of heating the oxidizing gas and/or the combustible before feeding it through the injection lance. The combustive gas and/or the combustible may e.g. be heated to a temperature above 150° C., preferably about 200° C.

The method may further comprise the step of cooling the tuyere body by feeding a cooling medium, generally water, through cooling channels arranged in the tuyere body. The cooling of the tuyere body protects the latter from excessive wear caused by the hot gas passing through the tuyere and the extremely hot conditions reigning inside the blast furnace.

Advantageously, the method comprises the further step of recovering top gas from the blast furnace; treating the recovered top gas; and injecting the treated top gas back into the blast furnace as reduction gas through the tuyere stock arrangement. Using top gas to be injected back into the blast furnace as reduction gas allows the top gas to be used again. By arranging the injection lance in the lance passage of the tuyere body, a reaction between the reduction gas carried by the blowpipe and the tuyere and the combustible carried by the injection lance can be reduced, thereby favoring a reaction between the combustible and the oxidizing gas, both carried by the injection lance. A better combustion can thereby be achieved and the blast furnace can be rendered more effective.

The step of treating the recovered top gas preferably comprises cleaning the recovered top gas; and/or reducing the carbon dioxide content of the recovered top gas; and/or increasing the carbon monoxide content of the recovered top gas. The cleaning of the recovered top gas may include passing the gas through a filter to remove dust particles and other debris from the recovered top gas. The reduction in $CO_2$ content and the increase in CO content allows the recovered top gas to be used as valuable reduction gas.

The method may further comprise the step of heating the reduction gas to a temperature of at least 900° C. before injection into the blast furnace. The reduction gas is preferably heated to a temperature between 1100 and 1300° C., preferably about 1250° C. This heating step may be carried out in a hot stove such as e.g. a Cowper.

BRIEF DESCRIPTION OF THE DRAWINGS

A preferred embodiment of the invention will now be described, by way of example, with reference to the accompanying drawing, in which.

DETAILED DESCRIPTION

Figure 1:
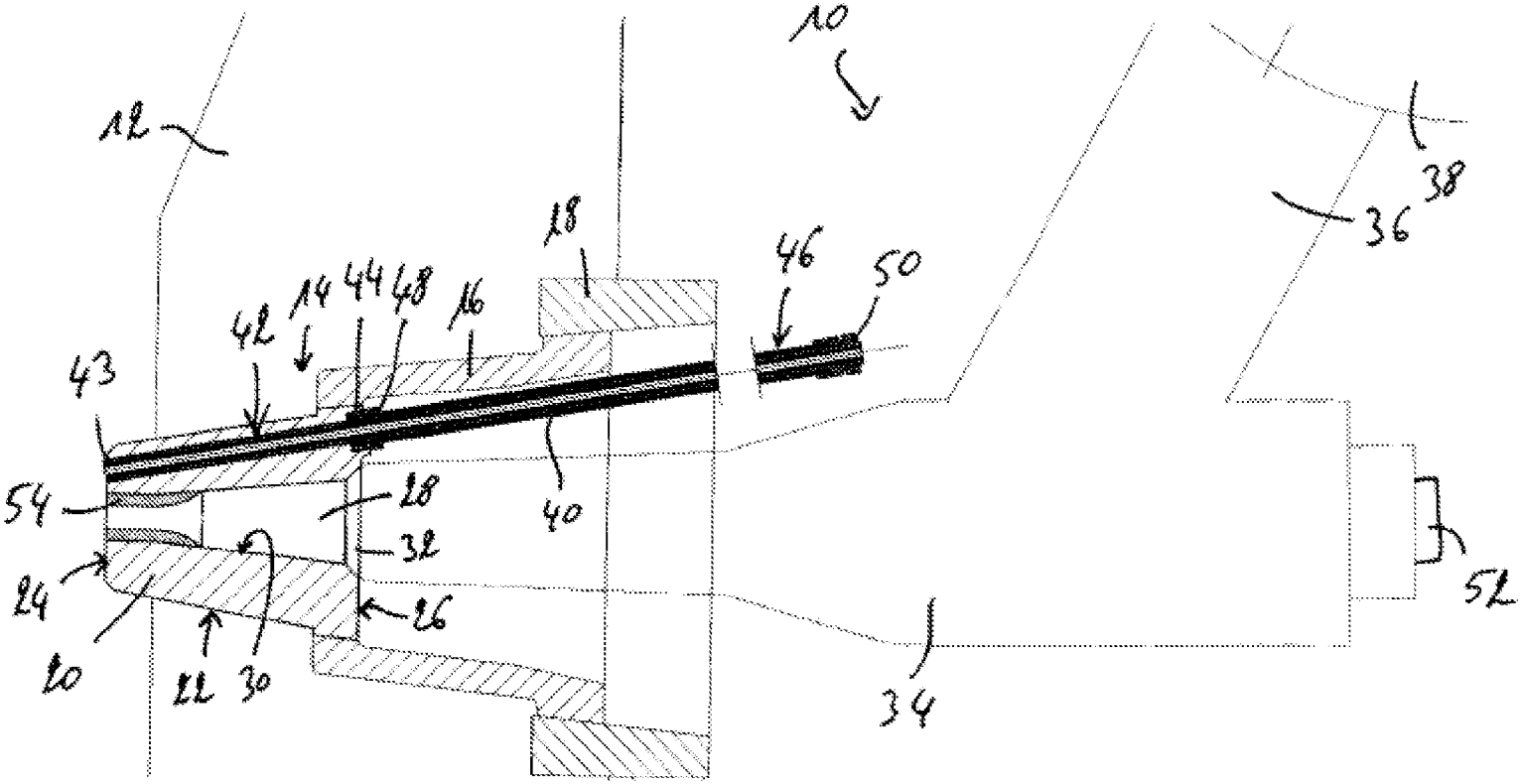
FIG. 1 is a schematic cut through a tuyere stock arrangement according to the present invention.

FIG. 1 shows a tuyere stock arrangement 10 for feeding gas through a furnace wall 12. The tuyere stock arrangement 10 comprises a tuyere 14 arranged in the furnace wall 12. The tuyere 14 is maintained in position by a tuyere cooler 16 and a tuyere cooler holder 18.

The tuyere 14 has a tuyere body 20 with an outer wall 22, a front face 24 and an opposite rear face 26. A tuyere channel 28 is centrally arranged through the tuyere body 20 and extends from the rear face 26 to the front face 24. The tuyere channel 28 forms an inner wall 30 in the tuyere body 20. The rear face 26 of the tuyere 14 is configured to receive a nose end 32 of a blowpipe 34, which is connected, with an opposite end 36 to a reduction gas feeding device 38 represented here by a bustle pipe 38. The blowpipe 34 is configured and arranged so as to feed hot gas from the bustle pipe 38 to the tuyere channel 28 for injection into the blast furnace.

Furthermore, an injection lance 40 is provided for feeding a combustible, generally pulverized or granular coal, into the blast furnace at the tuyere level. Due to the injection of the combustible into the blast furnace the amount of coke fed into the furnace can be reduced. As a combustible, such as e.g. coal, is generally cheaper than coke, this leads to a reduction in running costs of the blast furnace. Typically, injection lances are arranged such that they feed the combustible into the blowpipe 34 or into the tuyere channel 28. The combustible is then mixed with the hot gas, generally hot blast air, fed through the blowpipe 34.

In order to promote the combustion of the combustible, oxidizing gas such as oxygen may be provided. Such oxidizing gas is generally fed to the tip of the injection lance through a channel within the lance. Typically, coaxial lances are used, which comprise two concentric pipes wherein the inner pipe may e.g. carry the material and the outer pipe may carry the oxidizing gas. The inner pipe forms a separation wall within the lance to avoid contact between the combustible and the oxidizing gas before they both reach the tip of the lance. Coaxial lances are well known by the person skilled in the art and need not be further described herein.

The inventors have found it advantageous to arrange the injection lance 40 in a lance passage 42 formed in the tuyere body 20. Such a lance passage 42 is arranged between the inner wall 30 and the outer wall 22 of the tuyere body 20 and extends from the rear face 26 to the front face 24. The lance passage 42 thereby opens into the front face 24 of the tuyere body 20. The injection lance 40 can be arranged with its lance tip 43 essentially level with the front face 24 of the tuyere body 20. At the rear face 26, the tuyere body 20 comprises a socket 44 for connecting a lance holder 46. Such a lance holder 46 is formed by a hollow pipe having a central passage therethrough. The lance holder 46 has a first end 48 connected to the socket 44 in the rear face 26 of the tuyere body 20 and an opposite second end 50 protruding out of the blast furnace wall 12. The central passage of the lance holder 46 is dimensioned and arranged so as to receive the injection lance 40 therethrough. The lance holder 46 facilitates the access of the injection lance 40 to the lance passage 42 arranged through the tuyere body 20.

In some blast furnace installations, in particular in blast furnace installations with top gas recycling, the gas fed through the blowpipe 34 is not hot blast air, but reduction gas having a relatively high content in carbon monoxide. In such installations, the above arrangement is of particular importance. The feeding of the injection lance 40 through the lance passage 42 in the tuyere body 20 allows preventing the combustible and oxidizing gas coming into contact with the reducing gas within the tuyere stock arrangement.

A peep sight 52 may be arranged at a rear portion of the blowpipe 34 to visualize the operating conditions in the blast furnace through the tuyere channel 28. Due to the proposed arrangement of the injection lance 40, the latter does not cause an obstruction to the visual monitoring of the operating conditions through the tuyere channel 28. This is of particular importance if a tuyere insert 54 is arranged in the tuyere channel 28 to increase the speed of hot gas entering the blast furnace. Indeed, the inner diameter of the tuyere insert 54 may be close to the outer diameter of the injection lance 40.

Figure 2:
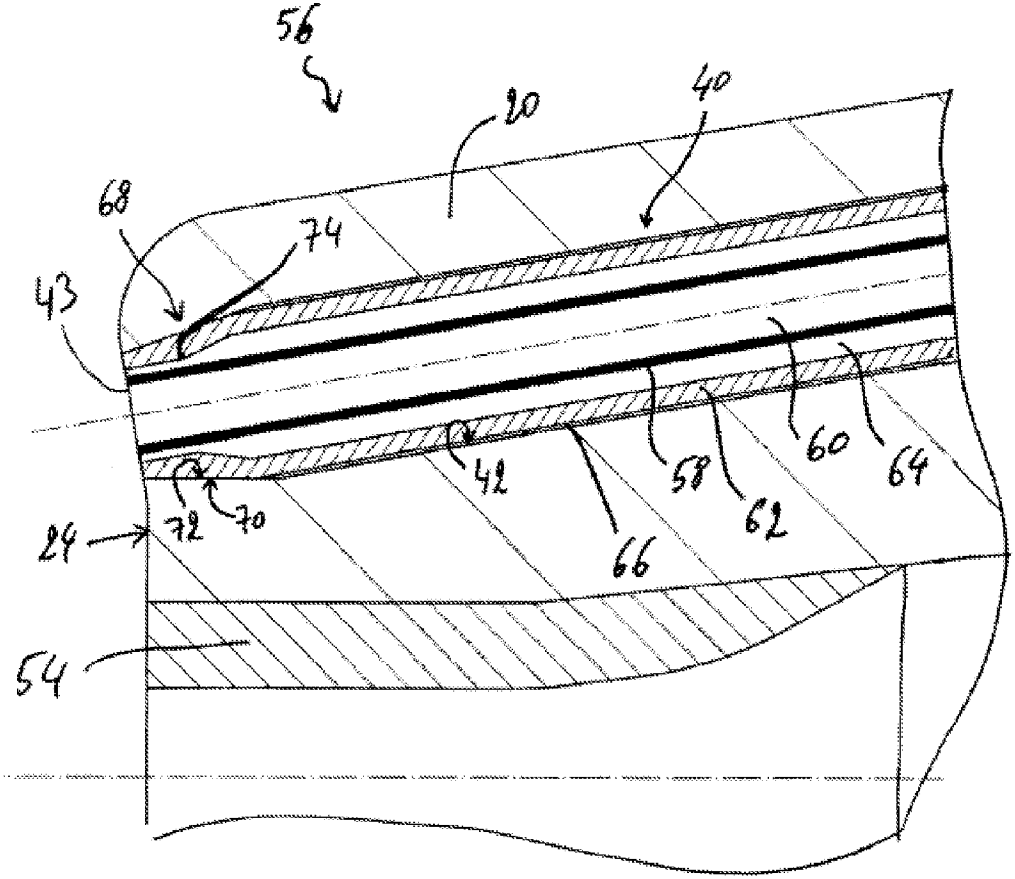
FIG. 2 is an enlarged view of a nose portion of the tuyere body of the tuyere stock arrangement of FIG. 1.

FIG. 2 partially shows a front portion 56 of the tuyere body 20 through which the lance passage 42 is arranged. An injection lance 40 is arranged in the lance passage 42 and comprises two concentric pipes. An inner pipe 58 forms a first channel 60 for carrying material to the lance tip 43. An outer pipe 62 is concentrically arranged around the inner pipe 58 so as to form an annular second channel 64 for carrying oxidizing gas to the lance tip 43. The inner pipe 58 forms a separation wall between the first and second channels 60, 64. The outer pipe 62 has an outer diameter that is smaller than the inner diameter of the lance passage 42 such that an annular gap 66, forming an insulation layer, is arranged between the injection lance 40 and the tuyere body 20. The annular gap 66 also facilitates installation of the injection lance 40 into the lance passage 42 and its removal therefrom.

At the front end 68 of the injection lance 40, the outer pipe 62 has a conical shape 70, narrowing in direction of the lance tip 43. The lance passage 42 has a corresponding narrowing 72 at the front end of the lance passage 42, such that, when the injection lance 40 is installed in the lance passage 42, the outer pipe 62 is in contact with the tuyere body 20. Firstly, this ensures that the injection lance 40 cannot be installed too far into the lance passage 42, thereby avoiding that the lance tip 43 protrudes from the lance passage 42 into the furnace itself. Secondly, the contact between the outer pipe 62 and the tuyere body 20 allows for a heat transfer between the lance tip 43 and the cooled tuyere body 20. It should be noted that the front end 68 of the injection lance 40 may comprise an insert on or in the outer pipe 62 for further improving the heat transfer between the lance tip 43 and the cooled tuyere body 20. The contact between the outer pipe 62 and the tuyere body 20, the latter being provided with cooling channels, allows to cool the front end of the outer pipe 62.

At the front end 68 of the injection lance 40, the outer pipe 62 further comprises an annular protrusion 74 on the inner wall of the outer pipe 62. Such an annular protrusion 74 reduces the flow cross-section of the second channel 64 carrying the oxidizing gas. This reduction of the flow cross-section increases the velocity of the oxidizing gas passing therethrough and therefore improves penetration of the oxidizing gas into the furnace.

The invention claimed is:

1. Tuyere stock arrangement for a blast furnace comprising:

a tuyere having a tuyere body configured for installation in a blast furnace wall; said tuyere body having an outer wall, a front face and a rear face, said tuyere body further having a tuyere channel extending from said rear face to said front face, said tuyere channel forming an inner wall in said tuyere body;

a blowpipe connected between said rear face of said tuyere body and a gas feeding device, said blowpipe being configured and arranged so as to feed hot gas from said gas feeding device to said tuyere channel for injection into said blast furnace;

an injection lance for feeding a combustible into said blast furnace at a tuyere level, said injection lance being a coaxial lance comprising an outer pipe and an inner pipe, coaxially arranged within said outer pipe, said outer and inner pipes being arranged for separately conveying oxidizing gas and said combustible, said inner pipe forming a separation wall for separating said combustible from said oxidizing gas;

wherein a lance passage is formed in said tuyere body, said lance passage being arranged between said inner wall and said outer wall of said tuyere body and extending from said rear face to said front face, said lance passage opening into a front face of said tuyere body, said lance passage being formed so as to removably receive said injection lance therein, said lance passage and said injection lance being dimensioned such that an annular gap is arranged between the injection lance and the tuyere body.

2. Tuyere stock arrangement according to claim 1, wherein a front end of said injection lance has a conical shape narrowing in a direction of said lance tip, said lance passage having a corresponding narrowing at the front end of said lance passage, such that, when said injection lance is installed in said lance passage, said outer pipe is, in a front end of said lance passage, in contact with said tuyere body.

3. Tuyere stock arrangement according to claim 1, wherein, in a front end of said injection lance, said injection lance is provided with an annular protrusion on an inner wall of said outer pipe and/or an outer wall of said inner pipe.

4. Tuyere stock arrangement according to claim 1, further comprising a lance holder, said lance holder comprising a hollow pipe with a central passage dimensioned so as to receive said injection lance therethrough, said lance holder having a first end connected to said rear face of said tuyere body and an opposite second end protruding out of said blast furnace wall.

5. Tuyere stock arrangement according to claim 1, further comprising a removable tuyere insert arranged in said tuyere channel of said tuyere body, said tuyere insert being configured so as to modify an outlet cross-section of said tuyere.

6. Method for feeding hot blast through a tuyere stock arrangement of a blast furnace, said method comprising:

providing a tuyere stock arrangement comprising a tuyere having a tuyere body installed in a blast furnace wall; said tuyere body having an outer wall, a front face and a rear face, said tuyere body further having a tuyere channel extending from said rear face to said front face, said tuyere channel forming an inner wall in said tuyere body, said tuyere stock arrangement further comprising a blowpipe connected between said rear face of said tuyere body and a gas feeding device, said blowpipe being configured and arranged so as to feed hot gas from said gas feeding device to said tuyere channel for injection into said blast furnace;

providing said tuyere body with a lance passage extending from said rear face to said front face of said tuyere body, said lance passage being arranged between said inner wall and said outer wall of said tuyere body, said lance passage opening into said front face of said tuyere body;

providing an injection lance for feeding a combustible into said blast furnace and removably arranging said injection lance in said lance passage; said lance passage being formed so as to removably receive said injection lance therein, said lance passage and said injection lance being dimensioned such that an annular gap is arranged between said injection lance and said tuyere body;

feeding a hot gas from said gas feeding device through said blowpipe and said tuyere channel into said blast furnace; and separately feeding said combustible and oxidizing gas into said blast furnace through said injection lance.

7. Method according to claim 6, wherein said method further comprises: heating said combustible and/or said oxidizing gas before feeding thereof to said injection lance.

8. Method according to claim 6, wherein said method further comprises:

recovering top gas from said blast furnace;

treating the recovered top gas; and injecting the treated top gas back into said blast furnace through the tuyere stock arrangement as reduction gas.

9. Method according to claim 8, wherein said treating said recovered top gas comprises:

cleaning said recovered top gas; and/or reducing a carbon dioxide content of said recovered top gas; and/or increasing a carbon monoxide content of said recovered top gas.

10. Method according to claim 8, wherein said method further comprises: heating the reduction gas to a temperature of at least 900° C. before injection into the blast furnace.

11. Method according to claim 6, further including the step of separately conveying heated oxidizing gas and/or heated combustible through said injection lance.

12. Method according to claim 11, further including the step of separately conveying oxidizing gas and/or said combustible at a temperature of at least 150° C. through said injection lance.

13. Method according to claim 6, further including the step of carrying hot gas from said gas feeding device having recycled treated top gas.

14. Method according to claim 6, further including the step of feeding pulverized or granular coal, granulated plastics, animal grease or flour, liquid fuel, natural gas or shredded tires into said blast furnace at a tuyere level through said injection lance.

* * * * *